US010073413B2

(12) United States Patent
Takada et al.

(10) Patent No.: US 10,073,413 B2
(45) Date of Patent: Sep. 11, 2018

(54) IMAGE FORMING APPARATUS WITH INTERNAL AIRFLOW

(71) Applicant: FUJI XEROX CO., LTD., Tokyo (JP)

(72) Inventors: Satoshi Takada, Kanagawa (JP); Satoru Nishikawa, Kanagawa (JP); Hirofumi Ueno, Kanagawa (JP); Xubin Zhou, Kanagawa (JP); Naoki Sambe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/453,345

(22) Filed: Mar. 8, 2017

(65) Prior Publication Data

US 2018/0067454 A1 Mar. 8, 2018

(30) Foreign Application Priority Data

Sep. 2, 2016 (JP) ..... 2016-171685

(51) Int. Cl.
*G03G 21/20* (2006.01)

(52) U.S. Cl.
CPC ..... *G03G 21/206* (2013.01)

(58) Field of Classification Search
CPC ..... G03G 21/20; G03G 21/206
See application file for complete search history.

(56) References Cited

U.S. PATENT DOCUMENTS

2016/0274537 A1* 9/2016 Yamashita ..... G03G 21/206

FOREIGN PATENT DOCUMENTS

JP 2012-68488 A 4/2012

* cited by examiner

*Primary Examiner* — Hoang Ngo
(74) *Attorney, Agent, or Firm* — Sughrue Mion, PLLC

(57) ABSTRACT

An image forming apparatus includes an air blowing device, an apparatus body, and at least one developer container that has an outer periphery, that is disposed in the apparatus body, and that contains developer. The image forming apparatus has a first transport path that allows a recording medium having undergone heat fixing is transported therethrough and a second transport path that extends in a different direction from a direction of the first transport path and that allows the recording medium to be transported along the outer periphery of the at least one developer container. A space is formed between the at least one developer container and the second transport path. The air blowing device is disposed between the first transport path and the at least one developer container, causes air to flow through the space so as to blow the air toward the first transport path.

16 Claims, 11 Drawing Sheets

IMAGE FORMING APPARATUS WITH INTERNAL AIRFLOW

CROSS-REFERENCE TO RELATED APPLICATIONS

This application is based on and claims priority under 35 USC 119 from Japanese Patent Application No. 2016-171685 filed Sep. 2, 2016.

BACKGROUND

Technical Field

The present invention relates to an image forming apparatus.

SUMMARY

According to an aspect of the present invention, an image forming apparatus includes an air blowing device, an apparatus body, and at least one developer container that has an outer periphery, that is disposed in the apparatus body, and that contains developer. The image forming apparatus has a first transport path that allows a recording medium having undergone heat fixing is transported therethrough and a second transport path that extends in a different direction from a direction of the first transport path and that allows the recording medium to be transported along the outer periphery of the at least one developer container. A space is formed between the at least one developer container and the second transport path. The air blowing device is disposed between the first transport path and the at least one developer container, causes air to flow through the space so as to blow the air toward the first transport path.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
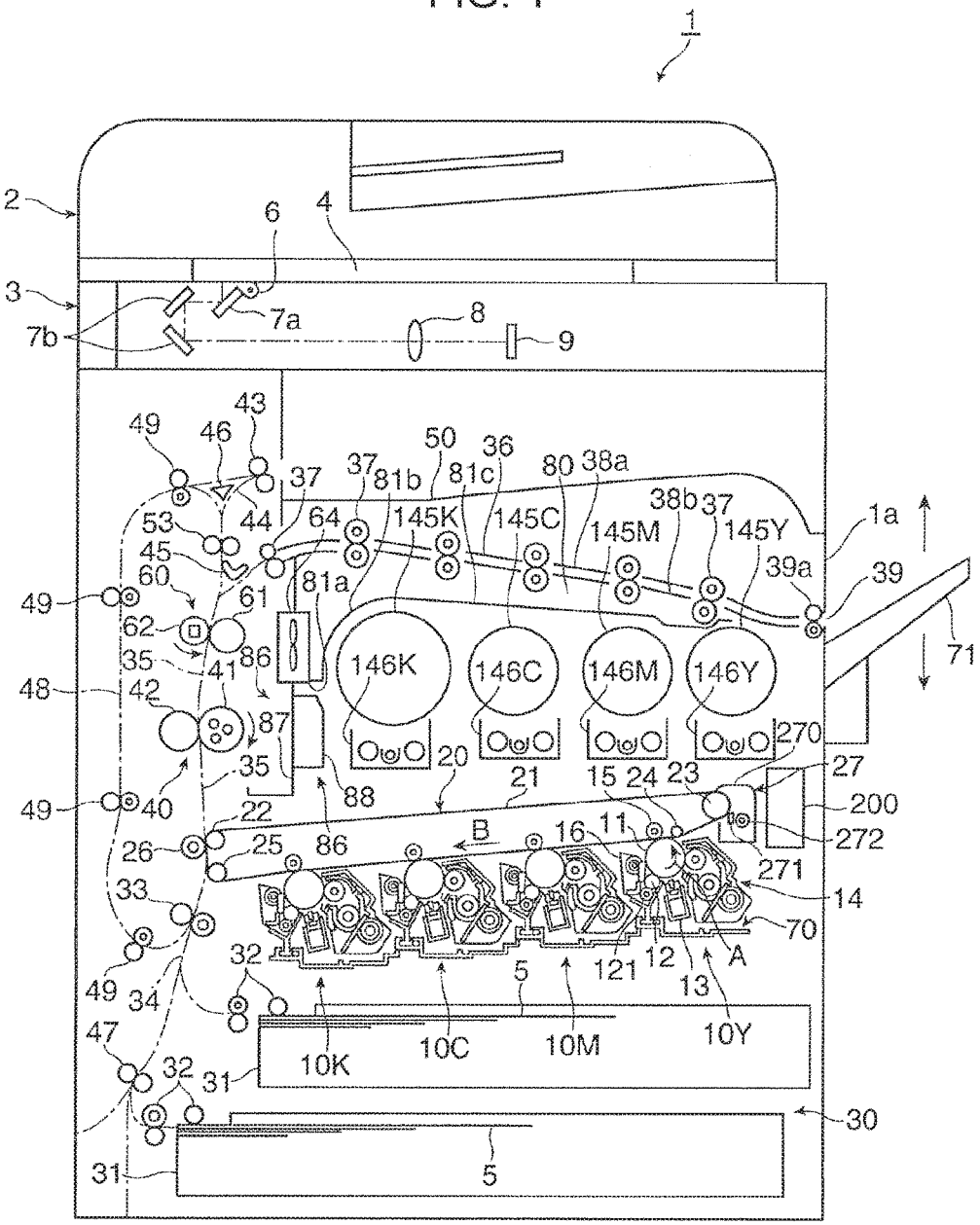
FIG. 1 is a structural view of an image forming apparatus according to a first exemplary embodiment of the present invention.
Figure 2:
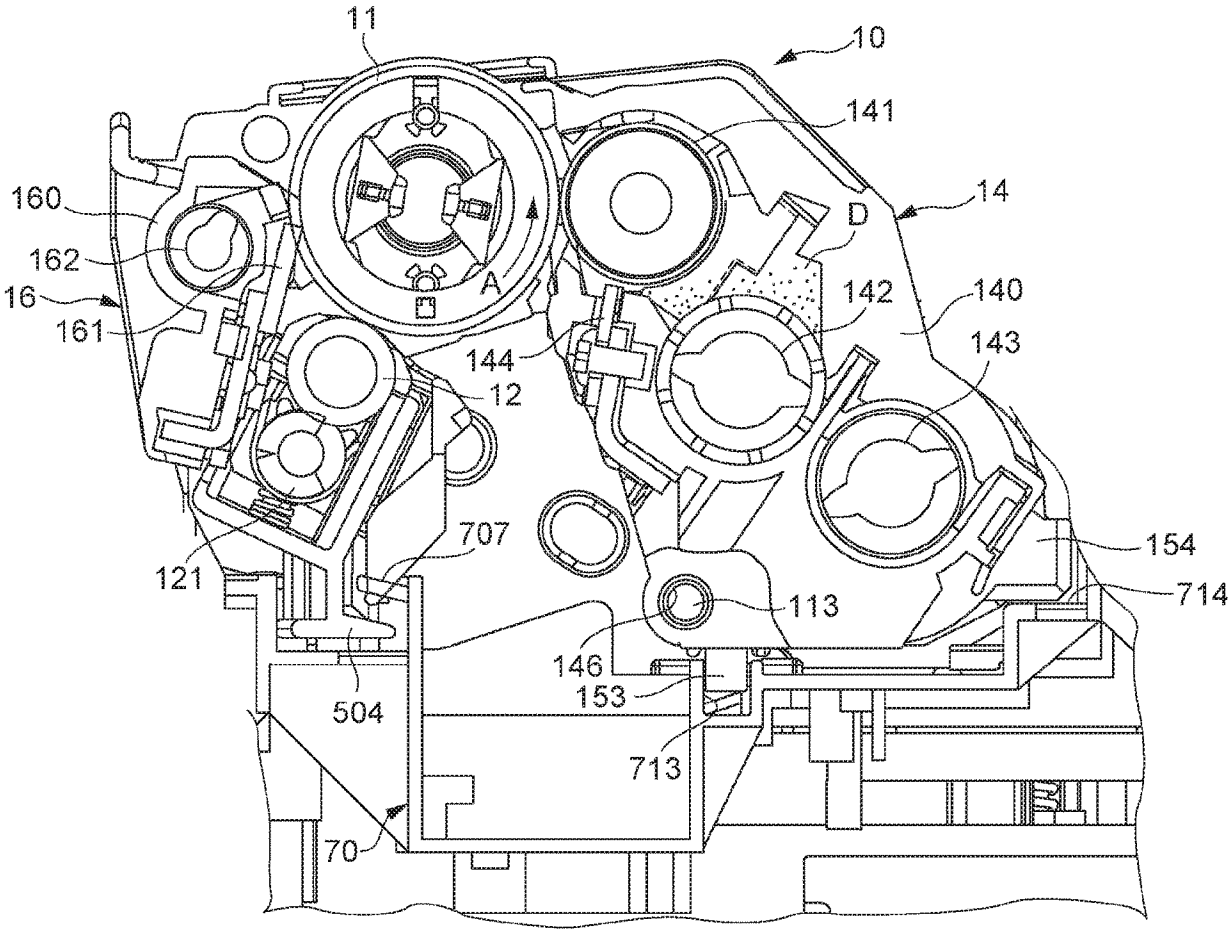
FIG. 2 is a structural sectional view of an image forming device of the image forming apparatus according to the first exemplary embodiment of the present invention.

FIGS. 1 and 2 illustrate an image forming apparatus according to a first exemplary embodiment. FIG. 1 is a schematic overall view of the image forming apparatus, and FIG. 2 is an enlarged view of parts (such as an image forming device) of the image forming apparatus.

An Overall Structure of the Image Forming Apparatus

An image forming apparatus 1 according to the first exemplary embodiment is structured as, for example, a full-color image forming apparatus for which the electrophotographic system is used. This image forming apparatus 1 includes an automatic document feeder 2 and an image reader 3 which are disposed above an apparatus body 1*a*. The automatic document feeder 2 automatically transports a document (not illustrated) to a reading position. The image reader 3 reads an image of the document (not illustrated) on a document placement glass 4.

The image reader 3 reads the image of the document (not illustrated) transported so as to pass through the reading position of the document placement glass 4 by the automatic document feeder 2 or placed on the document placement glass 4. The reading of the image is performed by illuminating the image of the document with a light source 6 and focusing the reflected light image from the document on an image reading element 9 with an imaging lens 8 through a full-rate mirror 7*a* and a half-rate mirror 7*b*.

The image forming apparatus 1 includes plural image forming devices 10, an intermediate transfer device 20, a sheet feed device 30, a fixing device 40, a decurler 60, and so forth. The image forming devices 10 form toner images developed with toner included in developer. The image forming devices 10 each serve as an example of an image forming unit. The intermediate transfer device 20 holds the toner images having been formed by the image forming devices 10 and transports the toner images to a second transfer position where the toner images are transferred through second transfer onto a recording sheet 5 at last. The recording sheet 5 serves as an example of a recording medium. Also, "recording sheet 5" is described in the plural form "recording sheets 5" where appropriate. The sheet feed device 30 contains and transports the required recording sheets 5 to be supplied to the second transfer position of the intermediate transfer device 20. The fixing device 40 fixes the toner images having been transferred through the second transfer by the intermediate transfer device 20 onto the recording sheet 5. The decurler 60 corrects the shape of the curled recording sheet 5 on which a fixing process has been performed by the fixing device 40. The decurler 60 serves as an example of a correction device. Also in FIG. 1, dotted chain lines indicate transport paths through which the recording sheet 5 is typically transported in the image forming apparatus 1.

The image forming devices 10 include four image forming devices 10Y, 10M, 10C, and 10K that each dedicatedly form a toner image of a corresponding one of four colors, that is, yellow (Y), magenta (M), cyan (C), and black (K). These four image forming devices 10Y, 10M, 10C, and 10K are arranged along an inclined line such that the yellow (Y) image forming device 10Y is disposed at a relatively upper position on the right side of the apparatus body 1*a* and the black (K) image forming device 10K is disposed at a relatively lower position on the left side of the apparatus body 1*a*.

As illustrated in FIG. 1, each of the yellow (Y), magenta (M), cyan (C), and black (K) image forming devices 10Y, 10M, 10C, and 10K includes a corresponding one of rotating photosensitive drums 11. The rotating photosensitive drum 11 serves as an example of an image holding member. Devices included in a unit that serves as an example of a toner image forming section are typically disposed around the photosensitive drum 11 as follows. These devices include, for example, a charger 12, a light exposure device 13, a developing device 14Y, 14M, 14C, or 14K, a first transfer device 15Y, 15M, 15C, or 15K, and a drum cleaner 16Y, 16M, 16C, or 16K. The charger 12 charges to a required potential a circumferential surface (image holding surface) of the photosensitive drum 11 on which an image formation is possible. The light exposure device 13 serving as an example of an electrostatic latent image forming unit radiates light in accordance with information (signal) of an image to the charged circumferential surface of the photosensitive drum 11 so as to form an electrostatic latent image (for a corresponding one of the colors) having a potential difference. The developing device 14 serving as an example of a developing section develops the electrostatic latent image with the toner of the developer of a corresponding one of the colors (Y, M, C, and K) so as to form a toner image. The first transfer device 15 serving as an example of a first transfer unit transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed.

The photosensitive drum 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in an arrow A direction by a motive force transmitted from a drive device (not illustrated).

The charger 12 includes a contact-type charging roller disposed so as to be in contact with the photosensitive drum 11. The charger 12 also includes a cleaning roller 121 that cleans a surface of the charger 12. A charging voltage is supplied to the charger 12. In the case where the developing device 14 performs reversal development, a voltage or a current the polarity of which is the same as that of the toner supplied from this developing device 14 is supplied as the charging voltage. The charger 12 may be a contactless-type charging device such as a scorotron disposed on the surface of the photosensitive drum 11 in a state in which the charger 12 is not in contact with the photosensitive drum 11.

The light exposure device 13 includes a light-emitting-diode (LED) print head. The LED print head includes plural LEDs as light emitting elements arranged in the axial direction of the photosensitive drum 11 so as to radiate the light in accordance with image information to the photosensitive drum 11, thereby forming the electrostatic latent image. Alternatively, the light exposure device 13 may use a laser light formed in accordance with the image information to perform deflection scanning in the axial direction of the photosensitive drum 11.

As illustrated in FIG. 2, each of the developing devices 14Y, 14M, 14C, and 14K includes, for example, a developing roller 141, two agitating and transport members 142 and 143, and a layer-thickness regulating member 144. These components are disposed in a housing 140 that has an opening and container chamber for the developer D. The developing roller 141 holds the developer D and transports the developer D to a developing region facing the photosensitive drum 11. The agitating and transport members 142 and 143 include screw augers or the like and transport the developer D while agitating the developer D so that the developer D passes through the developing roller 141. The layer-thickness regulating member 144 regulates the amount (layer thickness) of the developer D held by the developing roller 141. A developing bias voltage is supplied between the developing roller 141 and the photosensitive drum 11 of the developing device 14 from a power unit (not illustrated). Furthermore, each of the developing roller 141 and the agitating and transport members 142 and 143 is rotated in a required direction by a motive force transmitted from drive device (not illustrated). Furthermore, two-component developer that includes non-magnetic toner and magnetic carrier is used as the developer D of each of the four colors (Y, M, C, or K).

Each of the first transfer devices 15Y, 15M, 15C, and 15K is a contact-type transfer device that includes a first transfer roller. The first transfer roller is in contact with a circumference of the photosensitive drum 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes, for example, a body 160, a cleaning plate 161, and a feed member 162. The body 160 has a container shape and is partially opened. The cleaning plate 161 is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member 162 that includes a screw auger or the like collects the adhering matter such as toner removed by the cleaning plate 161 and transports the adhering matter so as to feed the adhering matter to a collection system (not illustrated). A plate shaped member (for example, blade) formed of, for example, rubber is used as the cleaning plate 161.

As illustrated in FIG. 1, the intermediate transfer device 20 is disposed above the image forming devices 10Y, 10M, 10C, and 10K. The intermediate transfer device 20 includes, for example, the intermediate transfer belt 21, plural belt support rollers 22 to 25, a second transfer device 26, and a belt cleaner 27. The intermediate transfer belt 21 serving as an example of an intermediate transfer body is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 26 serving as an example of a second transfer unit is disposed on the outer circumferential surface (image holding surface) side of the intermediate transfer belt 21 at a position where the intermediate transfer belt 21 is supported by the belt support roller 22. The second transfer device 26 transfers through the second transfer the toner images on the intermediate transfer belt 21 onto the recording sheet 5. The belt cleaner 27 cleans the outer circumferential surface of the intermediate transfer belt 21 by removing adhering matter such as toner or paper dust remaining on and adhering to the outer circumferential surface of the intermediate transfer belt 21 after the intermediate transfer belt 21 has passed through the second transfer device 26.

The intermediate transfer belt 21 is an endless belt formed of a material including, for example, synthetic resin such as polyimide resin or polyamide resin in which a resistance adjuster or the like such as carbon black is dispersed. The belt support roller 22 serves as a rear surface support roller for the second transfer. The belt support roller 23 serves as a drive roller rotated by a drive device (not illustrated). The belt support roller 24 serves as a surface forming roller that forms an image forming surface of the intermediate transfer belt 21. The belt support roller 25 serves as a tension applying roller that applies tension to the intermediate transfer belt 21.

As illustrated in FIG. 1, the second transfer device 26 (second transfer roller) is a contact-type transfer device that includes a second transfer roller that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 22 of the intermediate transfer device 20. A second transfer voltage is supplied to the second transfer roller at the second transfer position. As the second transfer voltage, a direct-current voltage is supplied from a power unit (not illustrated) to the second transfer roller 26 or the support roller 22 of the intermediate transfer device 20. The polarity of this direct-current voltage is opposite to or the same as the polarity to which the toner is charged.

As illustrated in FIG. 1, the belt cleaner 27 includes, for example, a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer so as to clean the circumferential surface of the intermediate transfer belt 21 by removing the adhering matter such as residual toner. The feed member 272 that includes a screw auger or the like collects the adhering matter such as toner removed by the cleaning plate 271 and transports the adhering matter so as to feed the adhering matter to a collection device (not illustrated). A plate-shaped member (for example, blade) formed of, for example, rubber is used as the cleaning plate 271.

The fixing device 40 includes, for example, a heating rotating member 41 and a pressure rotating member 42 which are disposed in a housing (not illustrated) having an entrance and an exit for the recording sheet 5. The heating rotating member 41 is in the form of a roller or a belt, rotated in a direction indicated by an arrow, and heated by a heating unit so that the surface temperature of the heating rotating member 41 is maintained at a specified temperature. The pressure rotating member 42 is in the form of a belt or a roller and in contact with the heating rotating member 41 substantially in the axial direction of the heating rotating member 41 with a specified pressure, thereby the pressure rotating member 42 is rotated. This fixing device 40 has a contact portion where the heating rotating member 41 and the pressure rotating member 42 are in contact with each other. This contact portion serves as a fixing process portion where the required fixing process (heating and applying pressure) is performed. The structure of the fixing device 40 will be described in detail later.

The decurler 60 includes, for example, a first decurler rotating member 61 and a second decurler rotating member 62. The first decurler rotating member 61 is in the form of a belt or a roller and transports the recording sheet 5 output from the fixing device 40 in a state in which the recording sheet 5 is curled in the opposite direction to a pressure contact direction of the contact portion where the heating rotating member 41 and the pressure rotating member 42 of the fixing device 40 are in contact with each other. The second decurler rotating member 62 is in the form of a roller or a belt and in contact with the first decurler rotating member 61 in the substantially axial direction with a specified pressure so as to be rotated. A pressure contact portion where the first decurler rotating member 61 and the second decurler rotating member 62 are in pressure contact with each other is a decurling portion. The structure of the decurler 60 will be described in detail later.

The sheet feed device 30 is disposed below the image forming devices 10Y, 10M, 10C, and 10K in the vertical direction. This sheet feed device 30 includes, for example, plural (or a single) sheet containers 31 and plural (or a single) feed devices 32. The sheet containers 31 each contain the stacked recording sheets 5 of a size, type, and so forth a user wishes to use. The feed devices 32 each feeds one sheet after another from the recording sheets 5 contained in a corresponding one of the sheet container 31. The sheet container 31 is attached so as to, for example, allow the sheet container 31 to be drawn to the front side (side facing a user who operates the sheet container 31) of the apparatus body 1*a* using a guide rail (not illustrated).

Examples of the recording sheets 5 include, for example, plain paper used for electrophotographic copiers, printers, and so forth, thin paper such as tracing paper, and overhead projector (OHP) transparencies. In order to further improve smoothness of image surfaces after fixing, smoothness of the front side of the recording media 5 may be increased as much as possible. For example, coated paper made by coating the front side of plain paper with resin or the like, so-called cardboard such as art paper for printing having a comparatively large basis weight, and the like may also be used.

As illustrated in FIG. 1, a sheet feed transport path 34 is provided in the vertical direction between the sheet feed device 30 and the second transfer device 26 on the left side of the apparatus body 1*a*. The sheet feed transport path 34 is formed by a single or plural sheet transport roller pairs 33 and a transport guide (not illustrated). The sheet transport roller pair 33 or the sheet transport roller pairs 33 transport each of the recording sheets 5 fed from the sheet feed device 30 to the second transfer position. The sheet transport roller pair or one of the sheet transport roller pairs 33 disposed at a position immediately upstream of the second transfer position in a sheet transport direction in the sheet feed transport path 34, serves as, for example, rollers that adjust timing at which the recording sheet 5 is transported (registration rollers). Furthermore, a sheet transport path 35 serving as an example of a first transport path is provided in a region from the second transfer device 26 to the upper side of the decurler 60. The recording sheet 5 having undergone the second transfer and fed from the second transfer device 26 is transported to the fixing device 40 and the decurler 60 through the sheet transport path 35. The sheet transport path 35 extends in the vertical direction that serves as a first transport direction.

Furthermore, a first output transport path 44 is provided above the decurler 60. The first output transport path 44 is provided with a transport roller 53 and a first sheet output roller pair 43. The transport roller 53 and the first sheet output roller pair 43 output the recording sheet 5 decurled by the decurler 60 to a first sheet output section 50 provided on an upper portion (upper end surface) of the apparatus body 1*a*.

Furthermore, a second output transport path 36 serving as an example of a second transport path is provided above the decurler 60. The second output transport path 36 allows the recording sheet 5 decurled by the decurler 60 to be transported in the substantially horizontal direction which is a second transport direction extending along an outer surface (upper end surface) of the apparatus body 1*a* in a different direction from the transport direction of the sheet transport path 35 and to be transported and output to a stack tray 71 serving as an example of a post-processing device provided on one side surface (right side surface) of the apparatus body 1*a*. The stack tray 71 is movable in the up-down direction and the front-rear direction and capable of receiving the recording sheets 5 output from the image forming apparatus 1 such that stacks of recording sheets 5 are received at output positions different from one another in the up-down direction and the front-rear direction. Here, each of the stacks of the recording sheets 5 includes a desired number (single or plural) of recording sheets 5. The post-processing device is not limited to the stack tray 71. The post-processing device may be a device that performs desired post-processing on the recording sheets 5 such as merging a batch of the recording sheets 5 with another batch of the recording sheets 5, performing punching and folding on the recording sheets 5, or performing punching on the recording sheets 5.

The second output transport path 36 is also provided with plural sheet transport roller pairs 37 that transport the recording sheet 5 and transport guides 38*a* and 38*b* disposed on the upper side and the lower side of the second output transport path 36, respectively, so as to face each other for guiding the recording sheet 5. A sheet output portion of the apparatus body 1*a* is provided with an opening 39 and a sheet output roller pair 39*a* for outputting the recording sheet 5.

Furthermore, a first switching gate 45 that switches the transport path between the first output transport path 44 and the second output transport path 36 is provided above the decurler 60. The rotational direction of the first sheet output roller pair 43 is switchable between a forward direction (output direction) and a reverse direction. Furthermore, a second switching gate 46 that switches the transport direction of the recording sheet 5 is provided immediately upstream of the first sheet output roller pair 43 in the sheet transport direction. In order to form images on both sides of the recording sheet 5, the rotational direction of the first sheet output roller pair 43 is switched from the forward direction (output direction) to the reverse direction after a trailing end of the recording sheet 5 on one side of which an image had been formed has been passed through the second switching gate 46. The transport path of the recording sheet 5 transported in the reverse direction by the first sheet output roller pair 43 is switched by the second switching gate 46 to the horizontal direction, so that this recording sheet 5 is transported to a duplex transport path 48 extending in the substantially vertical direction along a side surface of the apparatus body 1*a*. The duplex transport path 48 is provided with a sheet transport roller pairs 49, a transport guide (not illustrated), and so forth. The sheet transport roller pairs 49 transport the inverted recording sheet 5 to the sheet transport roller pair 33. Reference numeral 47 denotes a sheet transport roller pair that transports to the sheet transport roller pair 33 the recording sheet 5 fed from a manual feed tray (not illustrated) or the sheet container 31 or the sheet containers 31 disposed below the sheet transport roller pair 47.

Referring to FIG. 1, reference numerals 145Y, 145M, 145C, and 145K denote toner cartridges. The toner cartridges 145Y, 145M, 145C, and 145K each serve as an example of a developer container and have a cylindrical shape extending in a direction perpendicular to the page of FIG. 1. The toner cartridges 145Y, 145M, 145C, and 145K are arranged in the horizontal direction and contain the developer that includes at least the toner supplied to the respective developing devices 14Y, 14M, 14C, and 14K.

The toner cartridges 145Y, 145M, 145C, and 145K are disposed near and below the second output transport path 36 in an upper portion of the apparatus body 1*a*. In more detail, the second output transport path 36 is disposed below the first sheet output section 50 that forms the upper end surface being the outer surface of the apparatus body 1*a* and near outer circumferences of the plural toner cartridges 145Y, 145M, 145C, and 145K. According to the present exemplary embodiment, in order to ensure the amount of the toner (developer) contained in the toner cartridges 145Y, 145M, 145C, and 145K, the volume (diameter) of each of the toner cartridges 145Y, 145M, 145C, and 145K is increased as much as possible. Furthermore, the volume (diameter) of the toner cartridge 145K containing the black toner (K) is increased more than the volumes (diameters) of the other toner cartridges 145Y, 145M, and 145C for the colors for consideration of frequency of use (the amount of use) of the toner. Accordingly, the toner cartridges 145Y, 145M, 145C, and 145K are disposed in a region extending from the right side surface of the apparatus body 1*a* toward the fixing device 40 and the decurler 60 in the upper portion of in the apparatus body 1*a*. The black (K) toner cartridge 145K is disposed near the fixing device 40 in which heat is generated and the decurler 60 through which the recording sheet 5 right after undergoing the fixing and heated due to the fixing passes. Furthermore, all the toner cartridges 145Y, 145M, 145C, and 145K including the color toner cartridges 145Y, 145M, and 145C are disposed near and below the second output transport path 36 through which the recording sheet 5 right after undergoing the fixing and heated due to the fixing passes. The toner cartridges 145Y, 145M, 145C, and 145K are disposed at positions where the toner cartridges 145Y, 145M, 145C, and 145K are likely to be influenced by thermal effects produced by the fixing device 40, the decurler 60, and the recording sheet 5 passing through the second output transport path 36.

Toner transport devices 146Y, 146M, 146C, or 146K are provided below the respective toner cartridges 145Y, 145M, 145C, and 145K. The toner transport devices 146 each transport the toner supplied from a corresponding one of the toner cartridges 145Y, 145M, 145C, and 145K to a corresponding one of the developing devices 14Y, 14M, 14C, and 14K.

Furthermore, reference numeral 200 of FIG. 1 denotes a controller that controls entire operation of the image forming apparatus 1. The controller 200 includes components and so forth (not illustrated) such as a central processing unit (CPU), a read only memory (ROM), a random access memory (RAM), buses through which these CPU, ROM, and so forth are connected, and a communication interface.

Furthermore, reference numeral 70 of FIG. 1 denotes guide members. Each of the guide members guides a corresponding one of photosensitive units or a corresponding one of developing units when the photosensitive unit or the developing unit is attached to or detached from the apparatus body 1*a*. The photosensitive unit includes the photosensitive drum 11, the charger 12, and the drum cleaner 16 included in a corresponding one of the image forming devices 10. The developing unit is included in the developing device 14. As illustrated in FIG. 2, the guide member 70 includes a recess 707, a recess 713, and a step 714. A guide 504 provided at a lower end portion of each of the photosensitive units is guided by the recess 707. Projections 153 and 154 provided in each of the developing units are guided by the recess 713 and the step 714.

Operation of the Image Forming Apparatus

Basic image forming operation performed by the image forming apparatus 1 is described below.

Here, an operation in a full-color mode is described. In the full-color mode, a full-color image is formed by combining the toner images of four colors (Y, M, C, and K) by using four image forming devices 10Y, 10M, 10C, and 10K.

The image forming apparatus 1 is controlled by the controller 200. Upon reception of instruction information requesting a full-color image forming operation (printing) from an operating panel (not illustrated) attached to the image reader 3, a user interface (not illustrated), a printer driver (not illustrated), or the like, the image forming apparatus 1 starts four image forming devices 10Y, 10M, 10C, and 10K, the intermediate transfer device 20, the second transfer device 26, the fixing device 40, the decurler 60, and so forth.

Consequently, in the image forming devices 10Y, 10M, 10C, and 10K, as illustrated in FIGS. 1 and 2, first, the photosensitive drums 11 are rotated in the arrow A direction, and the chargers 12 charge the surfaces of the respective photosensitive drums 11 to the required polarity (negative polarity according to the first exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10Y, 10M, 10C, and 10K each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color. The toner is appropriately supplied to the developing devices 14 of the image forming devices 10Y, 10M, 10C, and 10K from the toner cartridges 145Y, 145M, 145C, and 145K.

Next, when the toner images of the colors formed on the photosensitive drums 11 of the image forming devices 10Y, 10M, 10C, and 10K are transported to the first transfer positions, the first transfer devices 15Y, 15M, 15C, and 15K transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10Y, 10M, 10C, and 10K where the first transfer has been performed. Thus, the image forming devices 10Y, 10M, 10C, and 10K are ready to perform the next image forming operation.

Next, the toner images having been transferred onto the intermediate transfer belt 21 through the first transfer are held by the intermediate transfer belt 21 and transported to the second transfer position by rotating the intermediate transfer belt 21 in the intermediate transfer device 20. Meanwhile, the sheet feed device 30 feeds the required recording sheet 5 to the sheet feed transport path 34 in accordance with the image forming operation. The recording sheet 5 is fed and supplied to the second transfer position by the sheet transport roller pair 33 serving as the registration rollers at timing adjusted to timing of the transfer in the sheet feed transport path 34.

The second transfer device 26 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and then transported to the fixing device 40 through the sheet transport path 35. The recording sheet 5 having undergone the second transfer is introduced into and passes through the contact portion between the heating rotating member 41 being rotated and the pressure rotating member 42 being rotated so as to be subjected to a required fixing process (heating and applying pressure) in the fixing device 40. Thus, the unfixed toner images are fixed onto the recording sheet 5. The recording sheet 5 having undergone the fixing process is transported along the sheet transport path 35 to the decurler 60. The recording sheet 5 curled by the fixing device 40 is decurled while passing through a contact portion where the first decurler rotating member 61 and the second decurler rotating member 62 are in contact with each other. The projection/recess relationship of the contact portion between the first decurler rotating member 61 and the second decurler rotating member 62 is in the opposite directions to that of the fixing device 40. After that, in the case of the image forming operation where image formation is performed on only one of the sides of the recording sheet 5, the decurled recording sheet 5 is output by the sheet transport roller pairs 37 to the stack tray 71 provided on the right side surface of the apparatus body 1*a* or by the first sheet output roller pair 43 to the first sheet output section 50 provided in the upper portion of the apparatus body 1*a*.

Furthermore, in the case of the image formation on both the sides of the recording sheet 5, the recording sheet 5 on one side of which an image has been formed is transported to the first sheet output roller pair 43, inverted by rotating the first sheet output roller pair 43 in the reverse direction instead of being output to the first sheet output section 50 by the first sheet output roller pair 43, and then transported again to the second transfer device 26 through the duplex transport path 48, thereby the toner images are transferred onto the back side of the recording sheet 5. The recording sheet 5 onto the back side of which the toner images have been transferred is transported to the fixing device 40 through the sheet transport path 35, subjected to the fixing process (heating and applying pressure) by the fixing device 40, decurled by the decurler 60, and output by the sheet transport roller pairs 37 or the like to, for example, the stack tray 71 provided on the right side surface of the apparatus body 1*a*.

Through the above-described operation, the recording sheet 5 is output on which the full-color image or the full-color images made by combining the toner images of four colors have been formed. Of course, the image forming apparatus 1 may form a monochrome image or monochrome images on the recording sheet 5 only with the black (K) image forming device 10K.

A Structure of the Fixing Device

Figure 3:
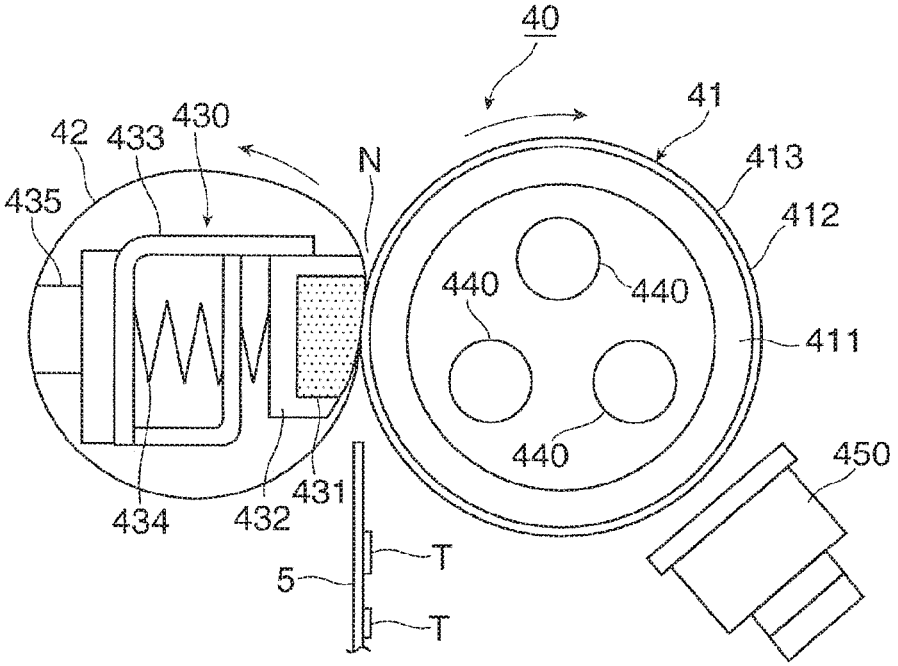
FIG. 3 is a structural sectional view of a fixing device.

FIG. 3 is a sectional view of the structure of the fixing device 40 used for the image forming apparatus 1 having the above-described structure.

As illustrated in FIG. 3, the fixing device 40 includes the heating roller 41, the pressure belt 42, a pressure member 430, and a single or plural heat sources 440. The heating roller 41 serving as an example of the heating rotating member heats unfixed toner images T on the recording sheet 5 so as to fix the unfixed toner images T. The endless belt-shaped pressure belt 42 serving as an example of the pressure rotating member presses the recording sheet 5 against the heating roller 41. The pressure member 430 presses the pressure belt 42 from an inner circumferential side of the pressure belt 42 toward the heating roller 41. The heat sources 440 are disposed inside the heating roller 41 and include, for example, halogen lamps so as to heat the heating roller 41. The heating roller 41 and the pressure belt 42 of the fixing device 40 are in contact (pressure contact) with each other in the contact portion. This contact portion serves as the fixing process portion (nip) N where the fixing process of heating and applying pressure is performed on the recording sheet 5.

The heating roller 41 includes a cored bar member 411, an elastic layer 412, and a mold release layer 413. The cored bar member 411 has a cylindrical shape formed of metal such as stainless steel, aluminum, or steel. The elastic layer 412 has heat resistance and is formed of, for example, silicone rubber coated on the surface of the cored bar member 411 to a predetermined thickness (for example, about 5 mm). The mold release layer 413 is formed of a material having a good mold releasing property such as a tube made of tetra fluoro ethylene-perfluoro alkylvinyl ether copolymer (PFA) coated on the surface of the elastic layer 412 to a thickness of about 50 μm. The heating roller 41 has a hollow cylindrical shape having an outer diameter of, for example, about 30 mm. Furthermore, the length of the heating roller 41 in the axial direction (longitudinal direction) is larger than a maximum width of the recording sheet 5. This length is, for example, 320 mm. The heating roller 41 is rotated in an arrow direction by a drive unit (not illustrated).

The pressure belt 42 is pressed against the surface of the heating roller 41 with a specified pressure by the pressure member 430 disposed on the inner circumferential side of the pressure belt 42. The pressure member 430 includes a pressure pad 431, a holding member 432, a support member 433, and a coil spring 434. The pressure pad 431 is in pressure contact with the surface of the heating roller 41 with the pressure belt 42 therebetween. The holding member 432 holds the pressure pad 431. The support member 433 supports the holding member 432. The coil spring 434 causes the pressure pad 431 to be in pressure contact with the heating roller 41. Furthermore, the surface of the pressure pad 431 is covered with a sheet-shaped low friction member (not illustrated) so as to reduce sliding resistance between the pressure pad 431 and the pressure belt 42, and a felt member 435 serving as a liquid lubricant supply member is disposed on the inner surface of the pressure belt 42.

The endless belt-shaped pressure belt 42 has an outer diameter of 30 mm and a thickness of 75 μm and is formed of synthetic resin such as polyimide. A mold release layer formed of, for example, PFA is provided on the surface of the pressure belt 42 according to need. Reference numeral 450 of FIG. 3 denotes a temperature sensor that detects the surface temperature of the heating roller 41.

A Structure of the Decurler

Figure 4:
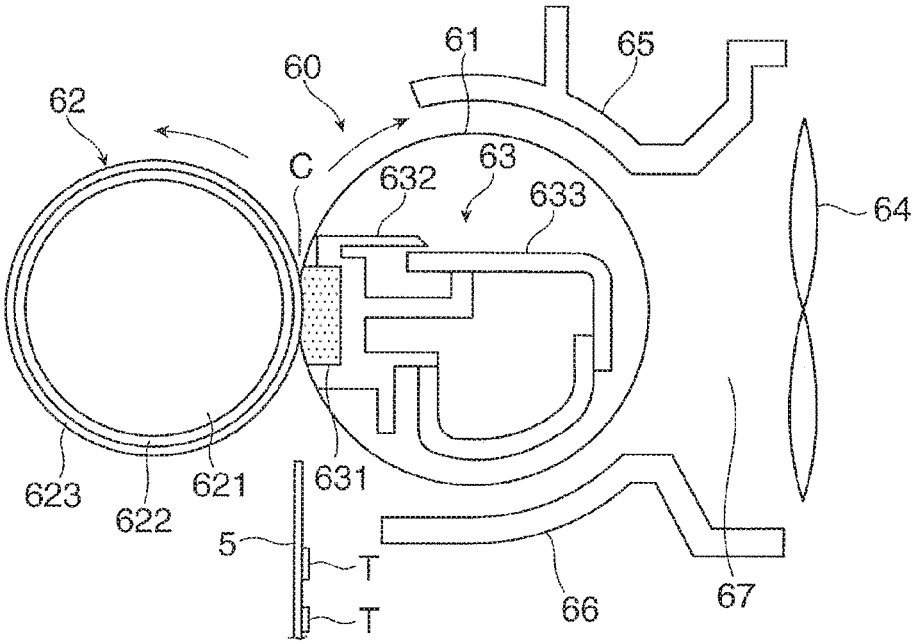
FIG. 4 is a structural sectional view of a decurler.

FIG. 4 is a structural view of the decurler used for the image forming apparatus according to the first exemplary embodiment.

As illustrated in FIG. 4, the decurler 60 includes the decurling belt 61, the decurling roller 62, and a pressure member 63. The endless belt-shaped decurling belt 61 is disposed on a heat-fixed toner image T (image) side of the recording sheet 5. The decurling roller 62 is disposed on a non-image side of the recording sheet 5. The pressure member 63 presses the decurling belt 61 from an inner circumferential side of the decurling belt 61 toward the decurling roller 62. The decurling belt 61 and the decurling roller 62 of the decurler 60 are in contact (pressure contact) with each other in a contact portion that serves as a decurling portion C where the recording sheet 5 is decurled.

The decurler 60 has a structure in which the decurling belt 61 serving as an endless belt-shaped member and the decurling roller 62 serving as a roller-shaped member are disposed such that the positional relationship between the decurling belt 61 and the decurling roller 62 is opposite to the positional relationship between the heating roller 41 and the pressure belt 42 of the fixing device 40. That is, in the decurler 60, the decurling belt 61 is disposed on the fixed toner image T side of the recording sheet 5 and the decurling roller 62 is disposed on the non-image side.

Curling in which the recording sheet 5 is deformed so as to be recessed toward the heating roller 41 side of the fixing device 40 (for convenience, referred to as "upward curling" herein) and curling in which the recording sheet 5 is deformed so as to be recessed toward the pressure belt 42 side of the fixing device 40 (for convenience, referred to as "downward curling" herein) occur depending on, for example, the structure of the fixing device 40, the material of the recording sheet 5, and further, the toner images T on the recording sheet 5. With the decurler 60 having the above-described structure, both the upward curling and the downward curling are corrected.

In more detail, it is assumed that the recording sheet 5 is upwardly curled, that is, deformed so as to be recessed toward the heating roller 41 side while passing through the fixing device 40 in which the heating roller 41 is disposed on the toner image T side and the pressure belt 42 is disposed on the non-image side. This recording sheet 5 tends to be downwardly curled, that is, deformed so as to be recessed toward the decurling roller 62 side while passing through the decurler 60 in which the decurling belt 61 is disposed on the toner image T side and the decurling roller 62 is disposed on the non-image side. Accordingly, the upward curling of the recording sheet 5 occurring when the recording sheet 5 is subjected to the heating and pressure applying process by the fixing device 40 is cancelled out by the downward curling occurring when the recording sheet 5 passes through the decurler 60, thereby the recording sheet 5 is decurled. This similarly applied to the opposite case.

The decurling belt 61 is formed of a flexible thin sheet-shaped member. The sectional shape of the decurling belt 61 before the decurling belt 61 is deformed by pressure contact with the decurling roller 62 is a thin cylindrical shape having an outer diameter of 20 to 50 mm. According to the present exemplary embodiment, the outer diameter of the decurling belt 61 is set to about 30 mm, that is, the same as the outer diameter of the heating roller 41. The decurling belt 61 is formed of, for example, a highly heat-resistant synthetic resin such as polyimide resin.

The decurling belt 61 may have a single layer structure including only a base material layer formed of, for example, polyimide resin. Alternatively, a surface mold release layer may be provided on the surface of the base material layer. In this case, the surface mold release layer is formed of, for example, PFA, polytetrafluoroethylene (PTFE), or a silicone copolymer, or may be a composite layer of these materials.

Furthermore, the decurling belt 61 is pressed against the surface of the decurling roller 62 with a specified pressure by the pressure member 63 disposed on the inner circumferential side of the decurling belt 61. The pressure member 63 includes a pressure pad 631, a holding member 632, and a support member 633. The pressure pad 631 is in pressure contact with the surface of the decurling roller 62 with the decurling belt 61 therebetween. The holding member 632 holds the pressure pad 631. The support member 633 supports the holding member 632. Furthermore, the surface of the pressure pad 631 is covered with a sheet-shaped low friction member (not illustrated) so as to reduce sliding resistance between the pressure pad 631 and the decurling belt 61 according to need, and a felt member (not illustrated) serving as a liquid lubricant supply member is disposed on the inner surface of the decurling belt 61.

The pressure pad 631 is formed of an elastic material such as, for example, silicone rubber or fluorocarbon rubber. However, the material of the pressure pad 631 is not limited to this. The pressure pad 631 may be formed of a synthetic resin material having heat resistance and lower thermal conductivity, for example, heat-resistant resin such as polyimide resin, polyamide resin, phenol resin, polyethersulfone (PES) resin, polyphenylenesulfide (PPS) resin, or a liquid crystal polymer (LCP). According to the present exemplary embodiment, the pressure pad 631 is formed of a heat-resistant elastic material such as silicone rubber or fluorocarbon rubber.

The decurling roller 62 includes a cored bar member 621, an elastic layer 622, and a mold release layer 623. The cored bar member 621 has a columnar shape or a cylindrical shape formed of metal such as stainless steel, aluminum, or steel. The elastic layer 622 has heat resistance and is formed of, for example, silicone rubber coated on the surface of the cored bar member 621 to a predetermined thickness (for example, about 5 mm). The mold release layer 623 is formed of a material having a good mold releasing property such as a tube made of PFA coated on the surface of the elastic layer 622 to a thickness of about 50 μm. The decurling roller 62 has a hollow cylindrical shape having an outer diameter of, for example, about 30 mm. Furthermore, the length of the decurling roller 62 in the axial direction (longitudinal direction) is larger than the maximum width of the recording sheet 5. This length is, for example, 320 mm. The decurling roller 62 is rotated in an arrow direction by a drive unit (not illustrated).

As illustrated in FIG. 4, the decurling belt 61 and the decurling roller 62 of the decurler 60 are brought into contact with the recording sheet 5 having undergone the heating and pressure applying process performed by the fixing device 40. Accordingly, the decurling belt 61 and the decurling roller 62 are heated by heat conduction from the recording sheet 5 having undergone the heating and pressure applying process, and the temperatures of the decurling belt 61 and the decurling roller 62 increase. In particular, when plural recording sheets 5 are continuously decurled, the temperatures of the decurling belt 61 and the decurling roller 62 tend to increase to comparatively high temperatures.

A Structure of a Characteristic Part of the Image Forming Apparatus

Figure 5:
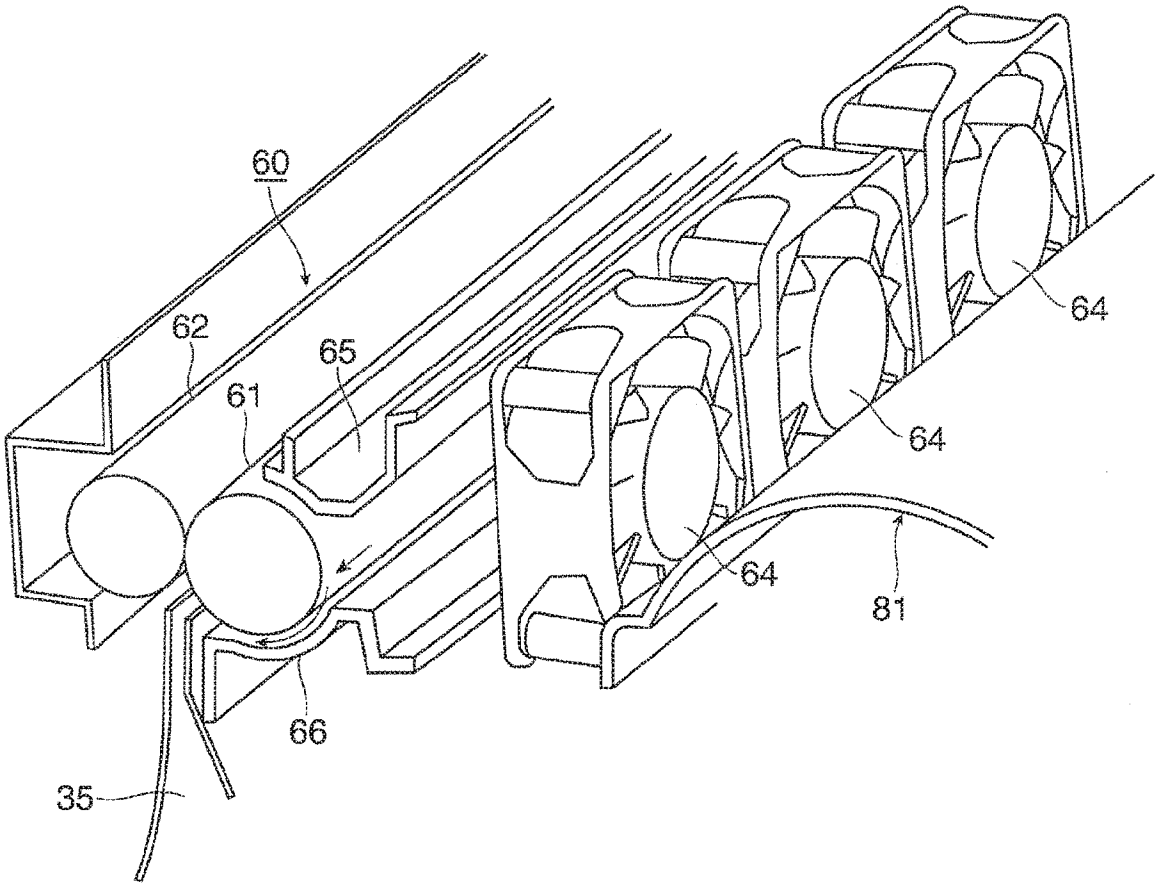
FIG. 5 is a structural perspective view of part of the image forming apparatus according to the first exemplary embodiment of the present invention.

FIG. 5 is a structural view of part of the image forming apparatus according to the first exemplary embodiment.

As illustrated in FIGS. 1 and 5, the image forming apparatus 1 according to the first exemplary embodiment includes plural (three in an example illustrated in FIG. 5) air blowing fans 64 provided between the sheet transport path 35 serving as the first transport path and the black (K) toner cartridge 145K. The air blowing fans 64 each serve as an example of an air blowing device and blow air toward the recording sheet 5 passing through the decurler 60 and the sheet transport path 35.

Furthermore, as illustrated in FIG. 4, the decurler 60 includes guide members 65 and 66 that guide an air flow from the plural air blowing fans 64 in a circumferential direction of the decurling belt 61. The guide members 65 and 66 are disposed above and below the decurling belt 61, respectively, form an air inlet 67 on the air blowing fan 64 side, and cover a substantially semi-circular range along an outer circumference of the decurling belt 61.

Figure 6:
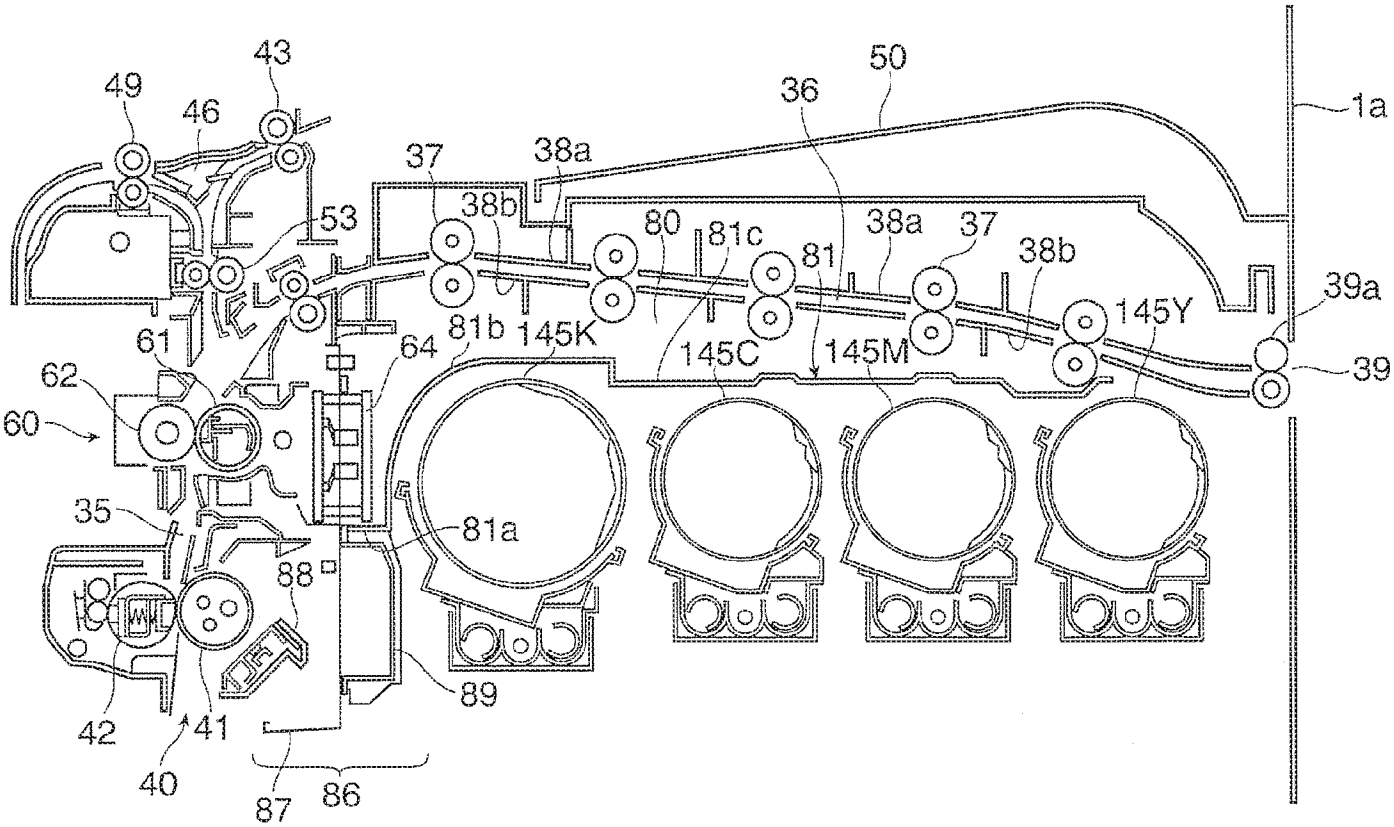
FIG. 6 is a structural sectional view of part of the image forming apparatus according to the first exemplary embodiment of the present invention.

As illustrated in FIG. 6, the air blowing fans 64 suck the outside air from the right side surface of the apparatus body 1*a* through an air-blowing space 80 formed between the toner cartridges 145Y, 145M, 145C, and 145K and the second output transport path 36. A thin plate-shaped covering member 81 that covers upper portions of the toner cartridges 145Y, 145M, 145C, and 145K is provided above the toner cartridges 145Y, 145M, 145C, and 145K. One end portion 81*a* of the covering member 81 is connected to lower end portions of the air blowing fans 64. The covering member 81 includes a curved portion 81*b* curved from lower end portions of the air blowing fans 64 along an outer circumferential shape of the black (K) toner cartridge 145K. The curved portion 81*b* is continuous with a flat plate portion 81*c* disposed substantially horizontally above the toner cartridges 145Y, 145M, 145C, and 145K. The distal end of the flat plate portion 81*c* is disposed above the yellow (Y) toner cartridge 145Y so as to avoid one of the sheet transport roller pairs 37.

The air blowing fans 64 suck the air through, for example, the opening 39 for outputting the recording sheet 5 or a louver (not illustrated) formed on the right side surface of the apparatus body 1*a*. The sucked air is blown toward the air blowing fans 64 through the air-blowing space 80 formed between the covering member 81 and the transport guide 38*b* positioned on the lower side of the second output transport path 36.

Figure 7:
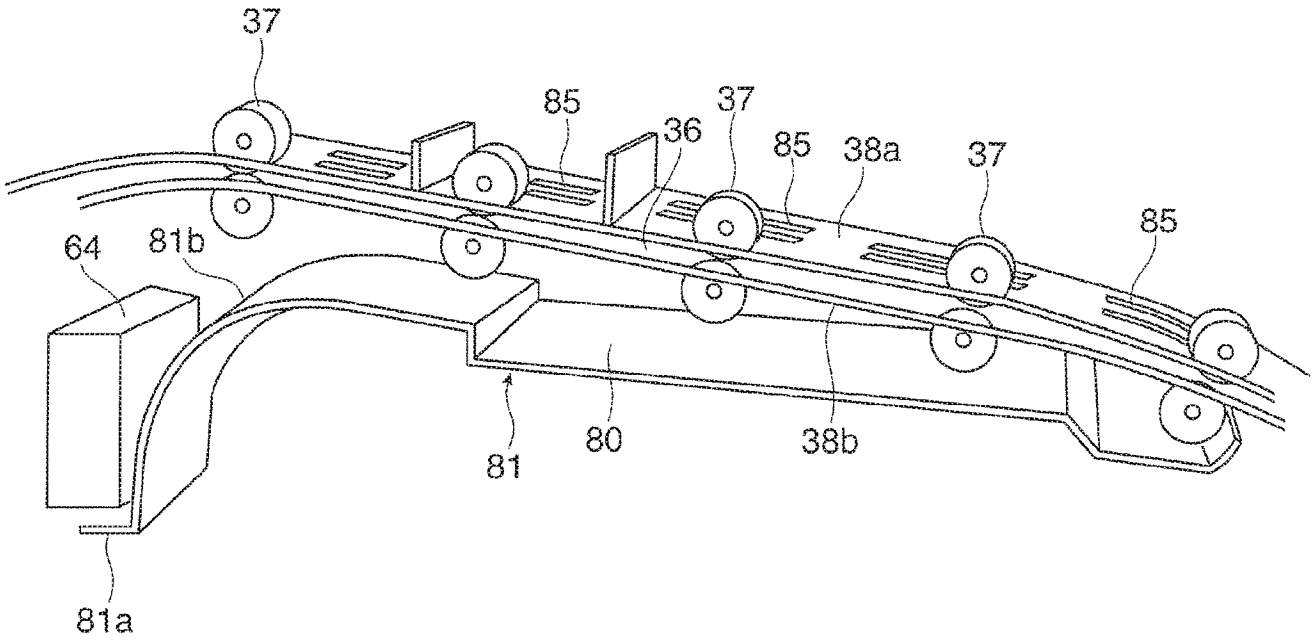
FIG. 7 is a structural perspective view of a second sheet output transport path.

Furthermore, as illustrated in FIG. 7, louvers 85 are provided in the upper transport guide 38*a* on the upper side of the second output transport path 36. The louvers 85 each have plural slit-shaped openings through which heat of the recording sheet 5 transported through the second output transport path 36 is released to the outside.

As illustrated in FIG. 6, a double duct 86 that covers the side of the heating roller 41 of the fixing device 40 with two ducts is provided below the air blowing fans 64. The double duct 86 has a first duct portion 88 and a second duct portion 89. The first duct portion 88 is formed by a space covered by a metal sheet 87 which has a substantially L shape in side view and disposed beside the heating roller 41 of the fixing device 40. The second duct portion 89 forms an air flow path that includes a closed space having a rectangular shape in sectional view on a rear surface side (toner cartridge side) of the metal sheet 87 that defines the first duct portion 88. The second duct portion 89 extends in the longitudinal direction of the fixing device 40 between the fixing device 40 and the toner cartridge 145K. The first duct portion 88 and the second duct portion 89 are provided substantially throughout the length of the fixing device 40 in the longitudinal direction.

Figure 8:
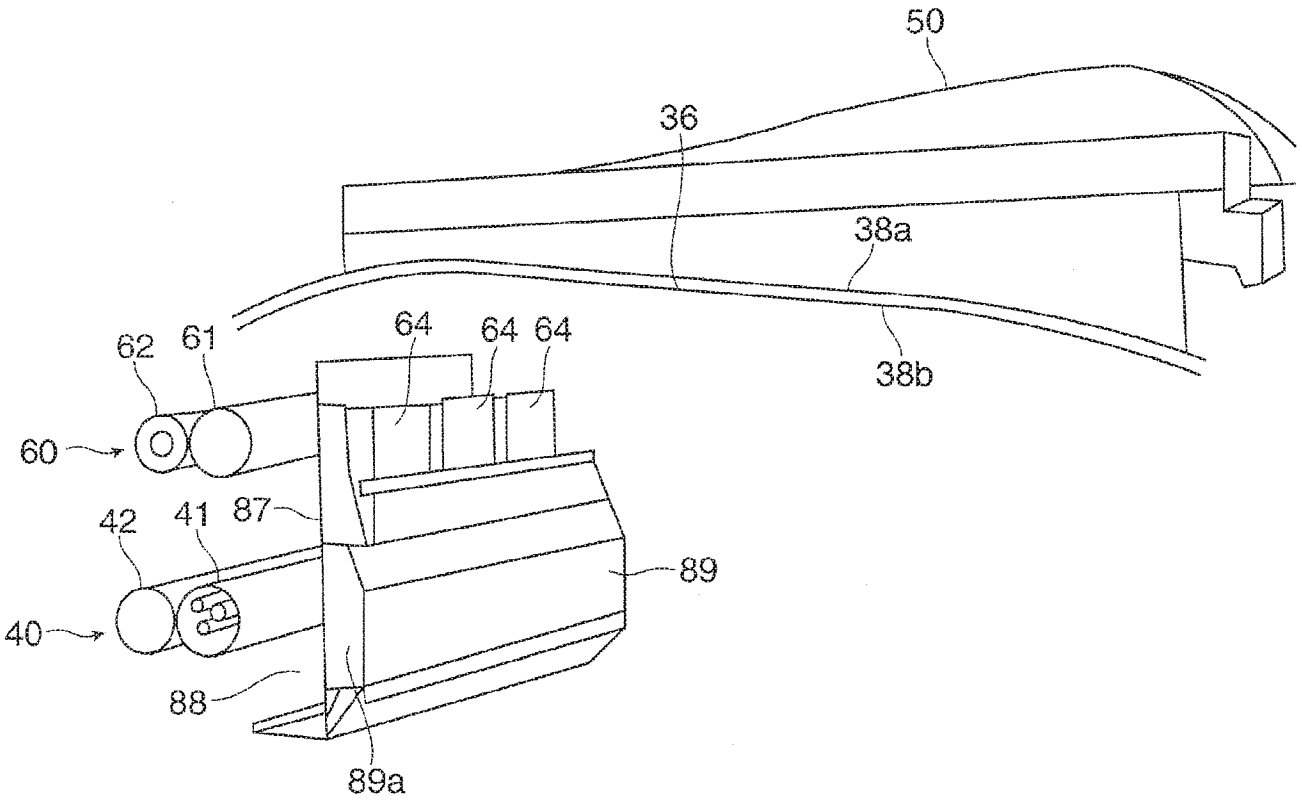
FIG. 8 is a structural perspective view of part of the image forming apparatus according to the first exemplary embodiment of the present invention.
Figure 9:
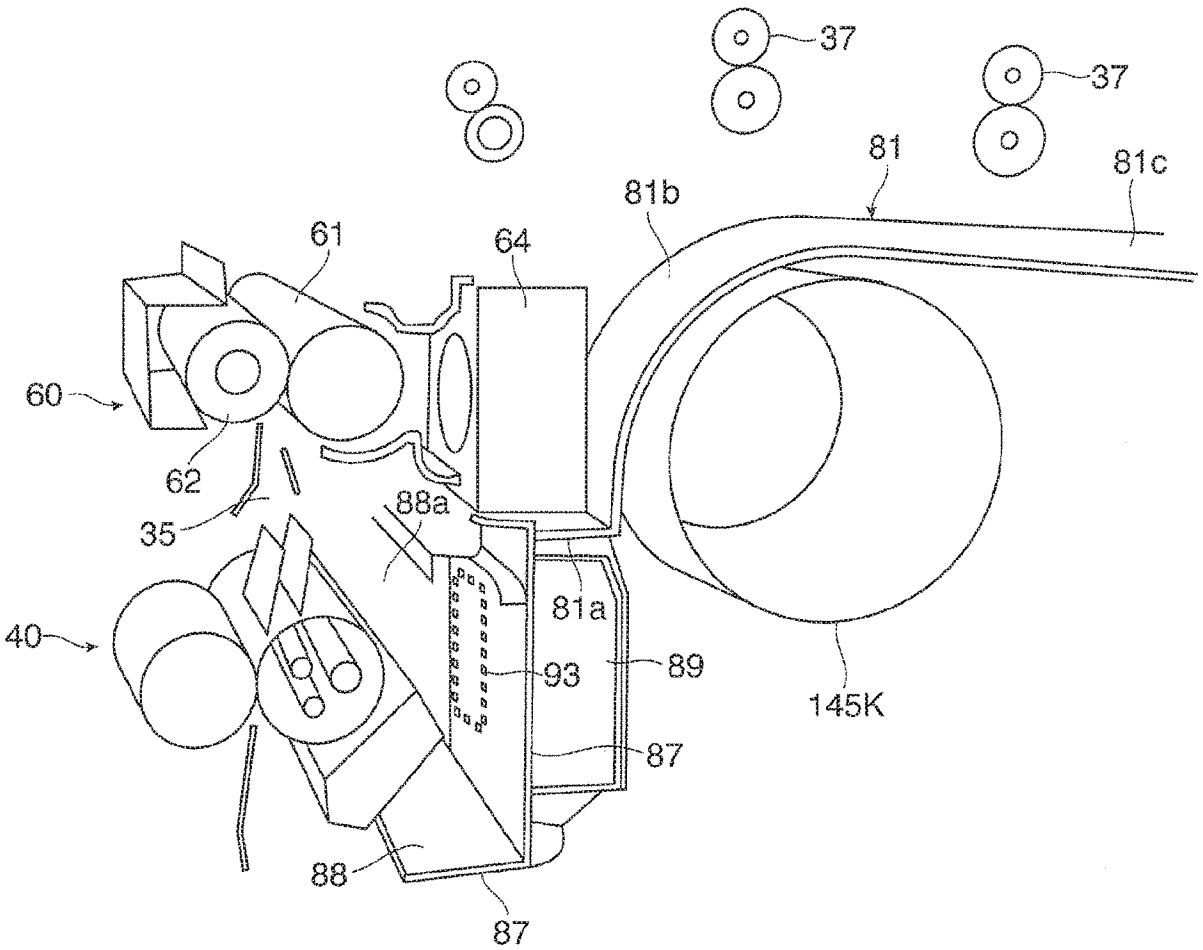
FIG. 9 is a structural perspective view of part of the image forming apparatus according to the first exemplary embodiment of the present invention.

As illustrated in FIG. 8, an end portion 89*a* of the second duct portion 89 on the front surface side of the apparatus body 1*a* is closed. Furthermore, as illustrated in FIG. 9, an end portion 88*a* of the first duct portion 88 on the rear surface side of the apparatus body 1*a* is closed. The first duct portion 88 communicates with the second duct portion 89 at the end portion 88*a* on the rear surface side of the apparatus body 1*a* through plural communicating holes 93 formed in the metal sheet 87.

Figure 10:
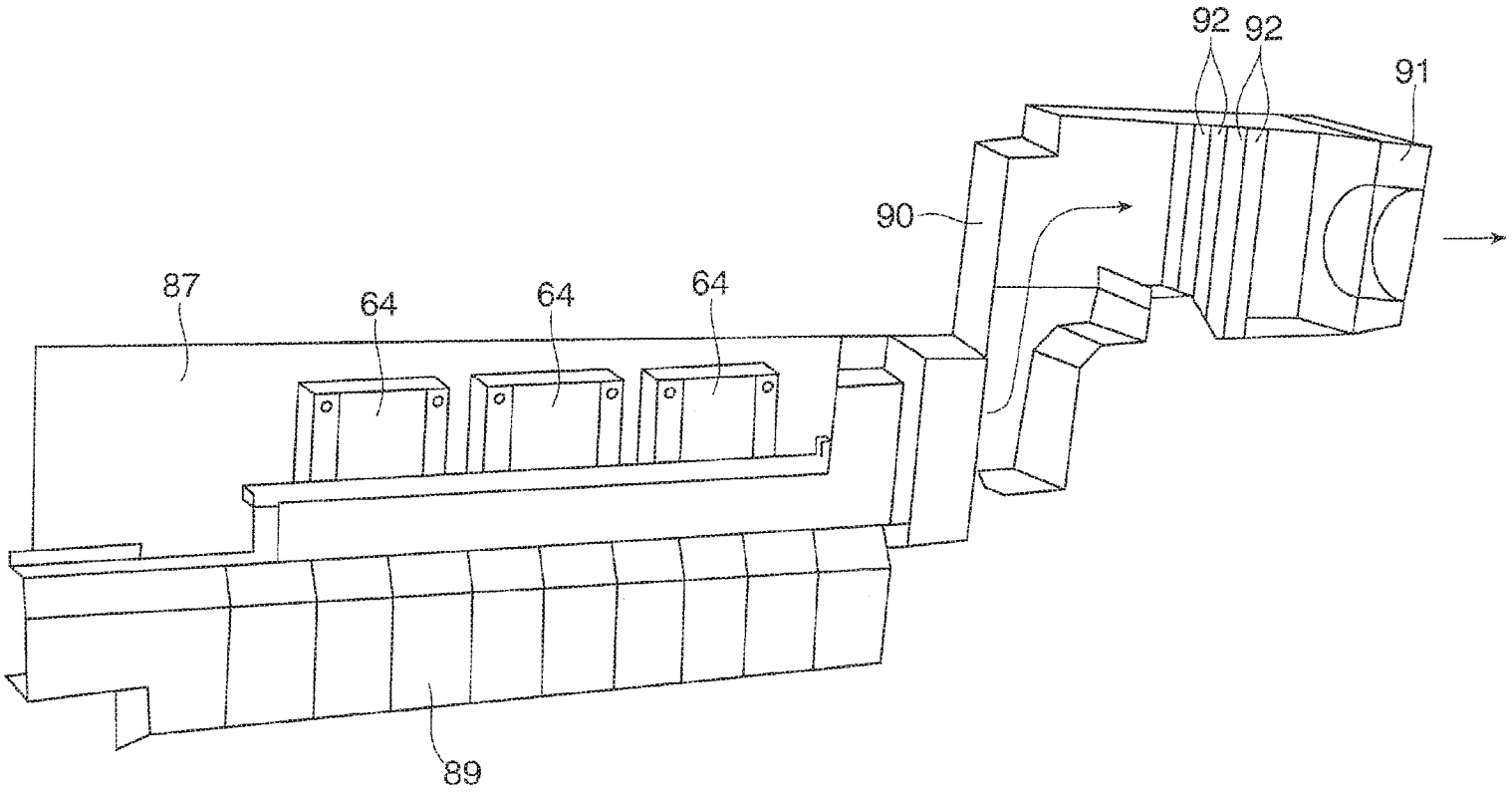
FIG. 10 is a partially cutaway structural perspective view of an exhaust duct.

As illustrated in FIG. 10, the second duct portion 89 is connected to an exhaust duct 90 on the rear surface side of the apparatus body 1*a*. The air around the fixing device 40 is sucked into the exhaust duct 90 from the second duct portion 89 through the first duct portion 88 and exhausted from the rear surface of the apparatus body 1*a* to the outside through plural filter members 92 by an exhaust fan 91 provided at an end portion of the exhaust duct 90 on the rear surface side. The filter members 92 remove components such as airborne toner, ultrafine particles (UFP), or volatile organic compounds (VOC) from the air exhausted from the fixing device 40.

Operation of the Characteristic Part of the Image Forming Apparatus

With the image forming apparatus 1 according to the first exemplary embodiment, influence of thermal effects produced by, for example, the fixing device 40 on the toner as the developer contained in the toner cartridges 145Y, 145M, 145C, and 145K may be suppressed as follows.

The recording sheet 5 onto which the toner images have been heat fixed by the fixing device 40 is, as illustrated in FIGS. 4 and 5, decurled by the decurler 60. In addition, the recording sheet 5 having been heated by the fixing device 40 is cooled by the air blown from the air blowing fans 64.

As illustrated in FIG. 1, the recording sheet 5 onto which the toner images have been fixed by the fixing device 40 is transported upward in the vertical direction through the sheet transport path 35 in the apparatus body 1*a* and introduced into the decurler 60.

As illustrated in FIG. 4, unlike the fixing device 40, the decurling belt 61 is disposed on the toner image T side of the recording sheet 5 and the decurling roller 62 is disposed on the non-image side of the recording sheet 5 in the decurler 60.

Accordingly, the recording sheet 5 upwardly curled after passing through the fixing device 40 depending on, for example, the structure of the fixing device 40, the material of the recording sheet 5, and further, a state of the toner images on the recording sheet 5 tends to be downwardly curled while passing through the decurler 60. As a result, the upward curling of the recording sheet 5 caused by the fixing device 40 and the downward curling of the recording sheet 5 caused by the decurler 60 cancel out each other in the recording sheet 5 having passed through the decurler 60, thereby the recording sheet 5 is decurled.

In contrast, the recording sheet 5 downwardly curled after passing through the fixing device 40 tends to be upwardly curled while passing through the decurler 60. As a result, the downward curling of the recording sheet 5 caused by the fixing device 40 and the upward curling of the recording sheet 5 caused by the decurler 60 cancel out each other in the recording sheet 5 having passed through the decurler 60. Thus, the recording sheet 5 is decurled also in this case.

Figure 11:
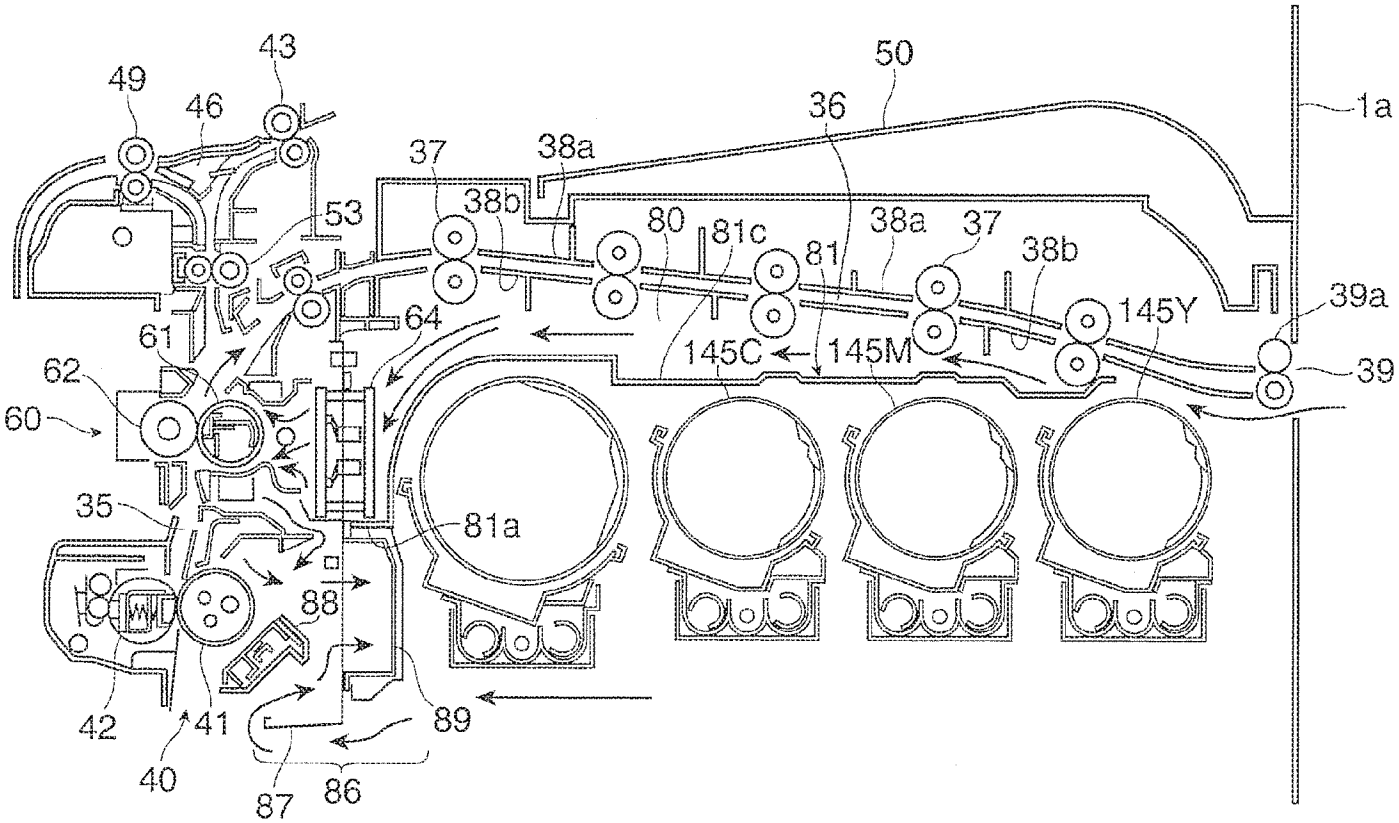
FIG. 11 is a structural sectional view illustrating operation of the image forming apparatus according to the first exemplary embodiment of the present invention.

Furthermore, as illustrated in FIG. 11, the recording sheet 5 having been heated while passing through the fixing device 40 is forcibly cooled by the air flow from the plural air blowing fans 64 while passing through the decurler 60. The plural air blowing fans 64 take in the outside air through the opening 39 provided in the side surface of the apparatus body 1*a* and sucks the air through the air-blowing space 80 formed between the toner cartridges 145Y, 145M, 145C, and 145K and the second output transport path 36.

Furthermore, the air flow blown from the plural air blowing fans 64 flows upward and downward in the vertical direction along the sheet transport path 35. Part of the air flow flowing downward in the vertical direction along the sheet transport path 35 is sucked into the second duct portion 89 of the double duct 86 through the first duct portion 88 of the double duct 86. Furthermore, the air positioned above the intermediate transfer belt 21 is sucked through a region below the first duct portion 88 and sucked into the second duct portion 89 through the first duct portion 88.

As illustrated in FIG. 10, the air flow sucked into the second duct portion 89 is discharged to the outside through the exhaust duct 90 from the rear surface side of the apparatus body 1*a* by the exhaust fan 91, and the components such as airborne toner, UFPs, or VOCs are removed from the air to be discharged by the filter members 92.

Accordingly, influence of thermal effects produced by the fixing device 40, the decurler 60, or the recording sheet 5 passing through the fixing device 40 and the decurler 60 on the toner contained in the black (K) toner cartridge 145K may be eliminated or suppressed even in the case where the black (K) toner cartridge 145K is disposed near the fixing device 40 and the decurler 60, because the air blowing fans 64 that blow the air toward the decurler 60 are disposed between the toner cartridge 145K and the fixing device 40 and the decurler 60.

Furthermore, since the air-blowing space 80 is formed between the toner cartridges 145Y, 145M, 145C, and 145K and the second output transport path 36, even in the case where the recording sheet 5 the temperature of which has not been sufficiently reduced passes through the second output transport path 36, influence of thermal effects on the toner cartridges 145Y, 145M, 145C, and 145K disposed near the second output transport path 36 may be eliminated or suppressed.

Second Exemplary Embodiment

Figure 12:
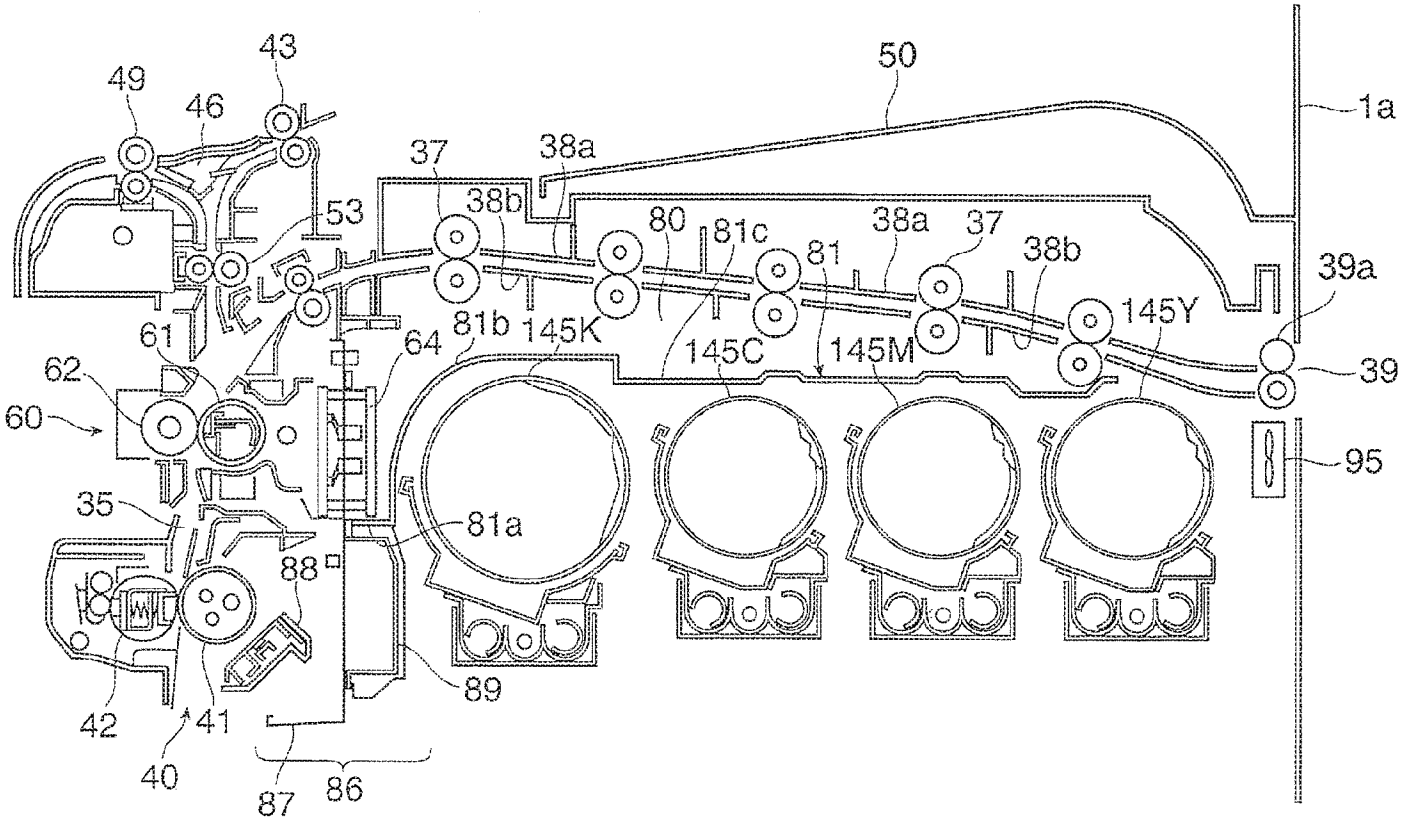
FIG. 12 is a structural view of an image forming apparatus according to a second exemplary embodiment of the present invention.

FIG. 12 illustrates the image forming apparatus according to a second exemplary embodiment.

As illustrated in FIG. 12, the image forming apparatus 1 according to the second exemplary embodiment includes an air intake fan 95 inside one side surface (right side surface of FIG. 12) of the apparatus body 1*a*. The air intake fan 95 sucks the outside air toward the air blowing fans 64.

According to the second exemplary embodiment, the outside air is forcibly sucked toward the air blowing fans 64 by the air intake fan 95. Thus, a cooling effect produced by the air blowing fans 64 on the decurler 60 and the recording sheet 5 may be improved. Furthermore, a configuration in which the air intake fan 95 blows the air not only toward the air blowing fans 64 but also toward the toner cartridges 145Y, 145M, 145C, and 145K and the recording sheet 5 passing through the second output transport path 36 is possible.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an air blowing device;

an apparatus body; and at least one developer container that has an outer periphery, that is disposed in the apparatus body, and that contains developer, wherein the image forming apparatus has a first transport path configured to allow a recording medium having undergone heat fixing to be transported therethrough and a second transport path that extends in a different direction from a direction of the first transport path and to allow the recording medium to be transported along the outer periphery of the at least one developer container, wherein a space is formed between the at least one developer container and the second transport path, and wherein the air blowing device is disposed between the first transport path and the at least one developer container and is configured to cause air to flow through the space so as to blow the air toward the first transport path.

2. The image forming apparatus according to claim 1, wherein the apparatus body has an outer surface, wherein the at least one developer container includes a plurality of developer containers arranged along the outer surface of the apparatus body, and wherein the second transport path is disposed in a direction in which the plurality of developer containers are arranged.

3. The image forming apparatus according to claim 2, further comprising:

a pair of guide members that extend along the second transport path so as to guide a front side and a back side of the recording medium, wherein one of the pair of guide members disposed farther from the plurality of developer containers than another of the pair of the guide members has an opening configured to allow heat from the recording medium to be released therethrough.

4. The image forming apparatus according to claim 1, further comprising:

a pair of guide members that extend along the second transport path so as to guide a front side and a back side of the recording medium, wherein one of the pair of guide members disposed farther from the at least one developer container than another of the pair of the guide members has an opening configured to allow heat from the recording medium to be released therethrough.

5. The image forming apparatus according to claim 1, wherein the air blowing device is configured to blow the air away from the space and directly onto the first transport path.

6. The image forming apparatus according to claim 1, further comprising a plurality of duct portions, configured to receive air blown over the first transport path from the air blowing device and to prevent at least a portion of the air from reentering the space by channeling the air along at least one of the duct portions, through at least one filter in the at least one of the duct portions and subsequently through an exhaust to an outside of the image forming apparatus.

7. The image forming apparatus according to claim 1, further comprising:

an opening at an end of the space opposite to the air blowing device with the second transport path disposed therebetween, wherein the air blowing device is further configured to pull the air into the image forming apparatus through the opening.

8. The image forming apparatus according to claim 7, further comprising:

a second air blowing device disposed at the opening and configured to blow the air from the opening and towards the air blowing device.

9. An image forming apparatus comprising:

a correction device;

an air blowing device;

an apparatus body; and at least one developer container that has an outer periphery, that is disposed in the apparatus body, and that contains developer, wherein the image forming apparatus has a first transport path, wherein the correction device is configured to correct a recording medium which has undergone heat fixing and which is transported through the first transport path, wherein the image forming apparatus has a second transport path that extends in a different direction from a direction of the first transport path and is configured to allow the recording medium having been corrected by the correction device to be transported along the outer periphery of the at least one developer container, wherein a space is formed between the at least one developer container and the second transport path, and wherein the air blowing device is disposed between the first transport path and the at least one developer container and is configured to cause air to flow through the space so as to blow the air toward the first transport path.

10. The image forming apparatus according to claim 9, wherein the apparatus body has an outer surface, wherein the at least one developer container includes a plurality of developer containers arranged along the outer surface of the apparatus body, and wherein the second transport path is disposed in a direction in which the plurality of developer containers are arranged.

11. The image forming apparatus according to claim 10, further comprising:

a pair of guide members that extend along the second transport path so as to guide a front side and a back side of the recording medium, wherein one of the pair of guide members disposed farther from the plurality of developer containers than another of the pair of the guide members has an opening configured to allow heat from the recording medium to be released therethrough.

12. The image forming apparatus according to claim 9, further comprising:

a fixing unit configured to fix an image to the recording medium, wherein, in a vertical direction, the correction device is disposed above the fixing unit, and wherein the air blowing device is disposed beside the correction device.

13. The image forming apparatus according to claim 12, further comprising an exhaust duct configured to allow the air heated by the fixing unit to be exhausted to an outside therethrough is disposed beside a developer container side of the fixing unit, and the exhaust duct is configured to form an air flow path in a longitudinal direction of the fixing unit.

14. The image forming apparatus according to claim 13, further comprising:

a pair of guide members that extend along the second transport path so as to guide a front side and a back side of the recording medium, wherein one of the pair of guide members disposed farther from the at least one developer container than another of the pair of the guide members has an opening configured to allow heat from the recording medium to be released therethrough.

15. The image forming apparatus according to claim 12, further comprising:

a pair of guide members that extend along the second transport path so as to guide a front side and a back side of the recording medium, wherein one of the pair of guide members disposed farther from the at least one developer container than another of the pair of the guide members has an opening configured to allow heat from the recording medium to be released therethrough.

16. The image forming apparatus according to claim 9, further comprising:

a pair of guide members that extend along the second transport path so as to guide a front side and a back side of the recording medium, wherein one of the pair of guide members disposed farther from the at least one developer container than another of the pair of the guide members has an opening configured to allow heat from the recording medium to be released therethrough.

* * * * *